US005349709A

United States Patent [19]

Cheng

[11] Patent Number: 5,349,709

[45] Date of Patent: Sep. 27, 1994

[54] ELEVATED FLOORBOARD FRAME FOR A PLAYPEN AND BABY BED

[75] Inventor: Ying-Hsiung Cheng, San Diego, Calif.

[73] Assignee: Top Fortune Ltd., San Diego, Calif.

[21] Appl. No.: 170,834

[22] Filed: Dec. 21, 1993

[51] Int. Cl.[5] ..... A47D 7/03

[52] U.S. Cl. ..... 5/93.1

[58] Field of Search ..... 5/93.1, 99.1, 11, 207, 5/208, 658, 655

[56] References Cited

U.S. PATENT DOCUMENTS

| | | | |
|---|---|---|---|
| 3,145,445 | 8/1964 | Megman et al. | 5/11 |
| 3,735,430 | 5/1973 | Platz | 5/93.1 |
| 3,848,277 | 11/1974 | Regvitti | 5/93.1 |
| 4,694,516 | 9/1987 | Overman, Sr. et al. | 5/93.1 |
| 4,744,114 | 5/1988 | Simpson et al. | 5/93.1 |

*Primary Examiner*—Alexander Grosz

*Attorney, Agent, or Firm*—Morton J. Rosenberg; David I. Klein

[57] ABSTRACT

An elevated floorboard frame for a playpen and baby bed includes a frame body made of a pair of parallel lengthwise rods and a pair of parallel lateral rods combined pivotally with connectors. Each of lengthwise and the lateral rod has two pieces pivotally connected with a connector so that the frame body may be collapsible to a minimum size. Each of the four support bands is connected with each of the U-shaped connectors at each corner of the frame body. Each of the four hanging hooks is connected with the top of each band to hook on an upper lateral rod of a playpen and baby bed to hang the elevated floorboard frame on the playpen.

1 Claim, 4 Drawing Sheets

ELEVATED FLOORBOARD FRAME FOR A PLAYPEN AND BABY BED

BACKGROUND OF THE INVENTION

A prior art elevated floorboard frame used in a playpen or baby bed 11 is shown in FIG. 7. The prior art floorboard frame includes locating blocks 12 to support the elevated floorboard frame 13 for supporting a floorboard upon which a baby lies. The elevated floorboard frame is to reduce bending of a person when placing the baby on the floorboard within the crib or playpen. Additionally, the bottom bed section of the playpen, baby bed, or crib may be used for storing toys or other articles. As the baby grows larger, the elevated floorboard may be removed.

The prior art elevated floorboard frame has the following disadvantages:

1. The elevated floorboard frame has to be removed when the playpen or crib is used for exercise by the baby;
2. The prior art floorboard is dimensionally large and occupies a large space making storage inconvenient; and
3. Locating blocks for supporting the floorboard are generally fixed limiting adjustment of the height of the floorboard which is inconvenient.

SUMMARY OF THE INVENTION

The subject adjustable and foldable frame system provides an elevated floorboard frame for a playpen, baby bed, or crib with the following advantages:

1. The subject system includes an elevated floorboard frame having four hooks for releasable coupling to two parallel lateral rods of a playpen, for easy mounting or removal from the playpen;
2. The vertical height of the elevated floorboard frame is adjustable by an adjusting hook mounted on a respective hanging band. Each hanging band has a top portion fixed to a respective hook and a bottom portion having a U-shaped connector coupled to a pair of longitudinally and laterally directed rods;
3. In order to provide additional room in the playpen, the elevated floorboard frame may be easily removed from the playpen and the floorboard folded to minimize storage space;
4. Non-removable locating blocks of the prior art are not provided which removes the latent danger of injury to the baby when the floorboard is taken off and the prior art locating blocks remain on the crib frame.

DESCRIPTION OF THE PREFERRED EMBODIMENTS

Figure 1:
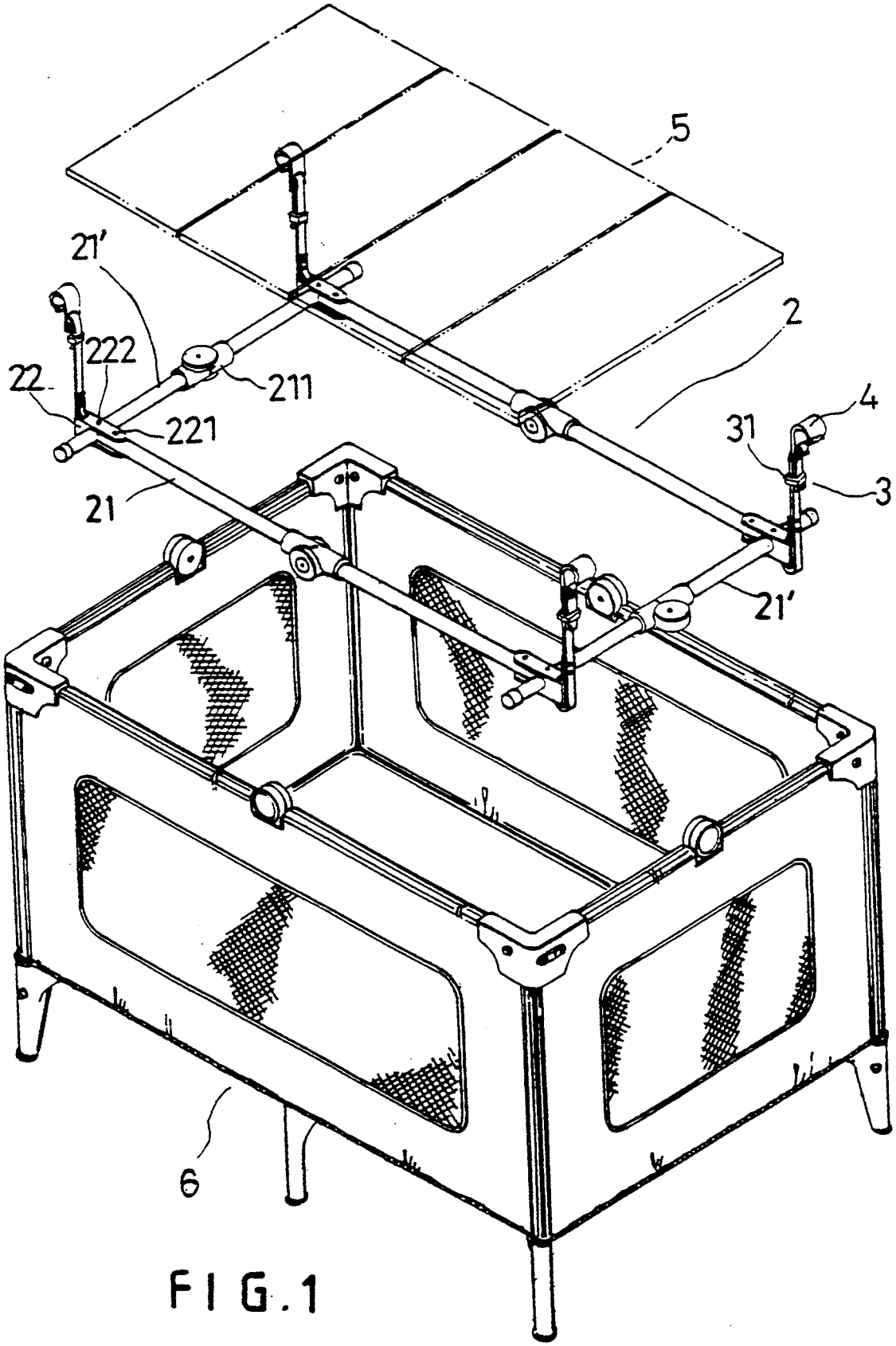
FIG. 1 is an exploded, perspective view of an elevated floorboard frame for a playpen and baby bed showing the present invention.
Figure 2:
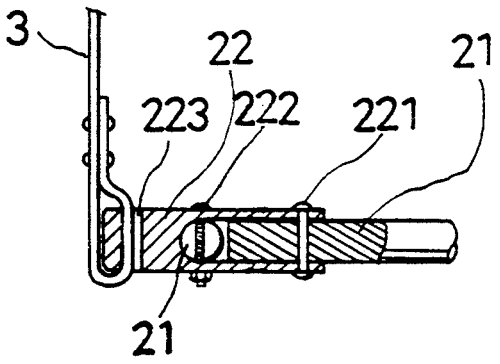
FIG. 2 is a partial cross-sectional cut-away view of the adjustable and foldable floorboard system for a playpen and baby bed of the present invention.

An adjustable and foldable floorboard frame system for a playpen, baby bed, or crib of the present invention is shown in FIGS. 1 and 2. The floorboard system includes a frame body 2, four hanging bands 3, four hooks 4, and a floorboard 5 for mounting on the playpen frame body 6.

Figure 5:
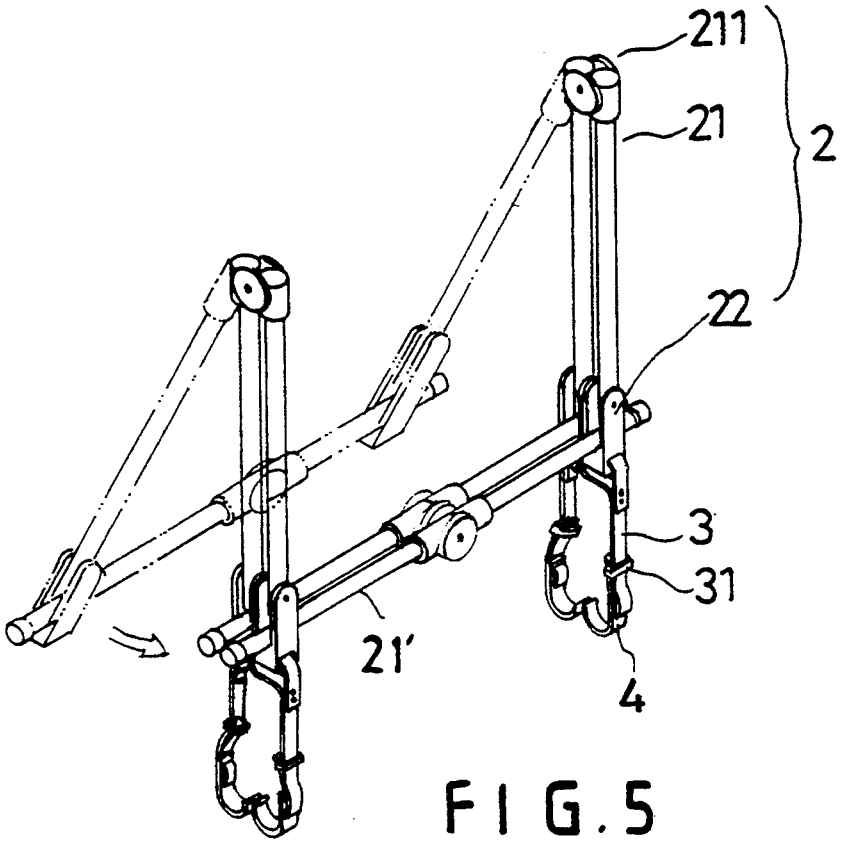
FIG. 5 is a perspective view of the adjustable and foldable floorboard frame system partially collapsed for the present invention.
Figure 6:
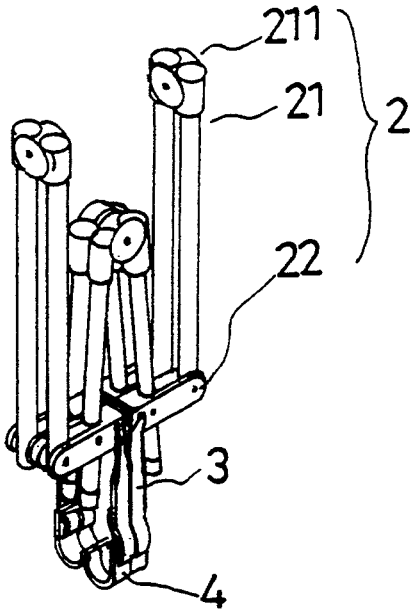
FIG. 6 is a perspective view of the adjustable and foldable floorboard frame system completely collapsed for the present invention; and, FIG. 7 is a side view of a prior art elevated floorboard frame.
Figure 7:
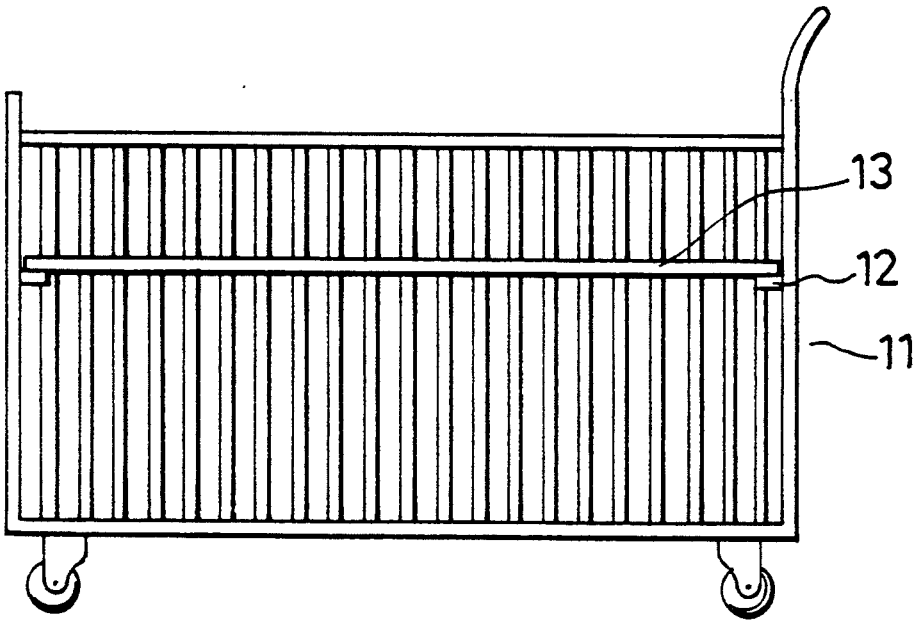
FIG. 7 (PRIOR ART)

The floorboard frame body 2 includes a pair of parallel longitudinally directed rods 21, 21, a pair of parallel laterally directed rods 21', and four U-shaped connectors 22, 22. Each longitudinally directed overall rod 21 is sectionally constructed into two rod sections connected pivotally each to the other by means of a connector 211 located centrally each to the other between the two rod sections of rod 21. Each connector 22 couples one end of a longitudinal rod 21 and one end of a lateral rod 21' to each other. Each connector 22 has an opening formed therein for insertion of an end of a respective longitudinally directed rod 21 to fit therein and the rod 21 is pivotally mounted thereto by a bolt member 221. The lateral rod 21' is also insertable in the opening and fixed firmly by a screw 222 as shown in FIG. 2. In this manner, the pair of longitudinal rods 2!, 21 form a collapsible frame body 2 as shown in FIGS. 5 and 6. Each connector 22 has a vertical through hole 223 for insert of a hanging band 3 for structural combination with the connector 22.

Figure 4:
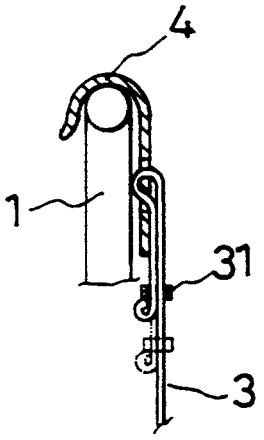
FIG. 4 is a cross-sectional, side view partially cutaway of a hanging band adjusted in vertical length for the elevated floorboard frame of the present invention.

Each of the four hanging bands 3 has a bottom end section passing through the vertical hole 223 in closed fashion and coupled firmly with rivets, as shown. An adjusting hook 31 is mounted to each band 3 for adjusting the length of the band 3, as shown in FIG. 4. A hanging hook 4 is located at a top end section of each band 3 for hooking to a longitudinal or laterally directed rod member of frame body 6 for the playpen or baby bed, in order to provide support for the frame body 2.

The floorboard 5 is a foldable board to be laid on the frame body 2 for a baby to lie thereon.

Figure 3:
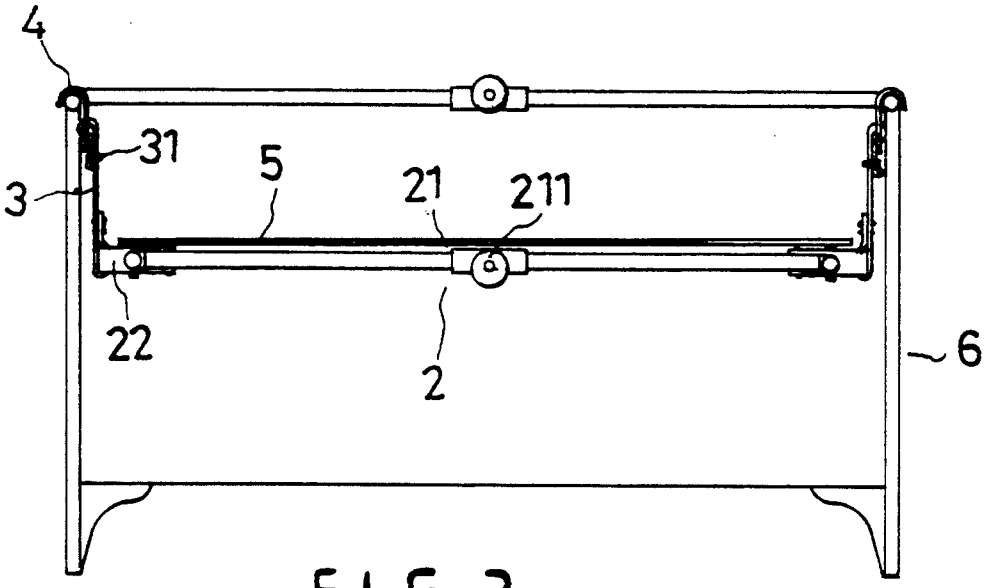
FIG. 3 is a side view of the adjustable and foldable floorboard system within a playpen, baby bed, or crib for the present invention.

FIG. 3 illustrates how the adjustable and foldable floorboard frame system is combined with the frame body 6 of a playpen and baby bed by means of the four hooks 4 located at the top end sections of the four bands 3 being hooked on lateral rods of the frame body 6 allowing a baby to lie on the floorboard 5.

FIG. 4 illustrates the band 3 adjustability of length prior to the frame being combined with the frame body 6 of the playpen and baby bed so that the floorboard 5 is positioned at a proper height to suit the height of a user.

FIGS. 5 and 6 illustrates the foldability of frame body 2 in a partial and complete folding relation. As seen, the connectors 211 are used for folding two sections of the longitudinally directed rod 21 and the lateral rod 21' to a minimal dimension. The floorboard 5 may also be spread out or folded, as seen, While the preferred embodiments of the invention have been described above, it will be recognized and understood that various modification may be made therein and the appended Claims are intended to cover all such modifications which may fall within the spirit and scope of the invention.

What is claimed is:

1. An adjustable and foldable floorboard frame system for a playpen, baby bed or crib comprising:

a frame body consisting of (1) a pair of parallel longitudinally directed rods, and (2) a pair of parallel laterally directed rods, each of said longitudinally directed rods being formed of respective rod sections connected pivotally each to the other by a connector at a first end of each rod section, a second end of each rod section is pivotally connected within an open end of a U-shaped connector, each of said parallel laterally directed rods being formed of respective lateral rod sections connected pivotally with a lateral connector at a first end of each lateral rod section a second end of each of said lateral rod sections is connected to a respective U-shape connector located at each of four corners of said frame body;

four support bands respectively having a lower end protruding through a vertically formed hole in each of said U-shaped connectors bent upon itself and riveted firmly holding an end of said U-shaped connector, and an adjusting hook mounted around each said support band for adjusting the length of each said support band;

a hanging hook being fixed at a top section of each of said support bands for capturing lateral rods of said playpen, baby bed, or crib; and, a floorboard having a plurality of foldable boards foldably connected together being laid on said frame body for a baby to lie thereon.

* * * * *